US005142948A

United States Patent [19]

Liou

[11] Patent Number: 5,142,948

[45] Date of Patent: Sep. 1, 1992

[54] HAMMER AND METHOD FOR MANUFACTURE THE SAME

[76] Inventor: Mou T. Liou, No. 25, Lane 86, Tawei Rd., Tali Hsiang, Taichung Hsien, Taiwan

[21] Appl. No.: 766,541

[22] Filed: Sep. 27, 1991

[51] Int. Cl.[5] ..... B21K 5/14

[52] U.S. Cl. ..... 76/103; 76/119; 81/25

[58] Field of Search ..... 76/103, 119, 114, DIG. 3; 72/412, 470; 29/412, 415; 81/20, 25

[56] References Cited

U.S. PATENT DOCUMENTS

| | | | |
|---|---|---|---|
| 6,623 | 8/1875 | Parker | 76/103 |
| 270,883 | 1/1883 | Bailey | 81/20 |
| 524,129 | 8/1894 | Bryant | 76/101.1 |
| 1,669,701 | 5/1928 | Estwing | 76/103 |
| 1,711,505 | 5/1929 | McCracken | 76/101.1 |
| 3,442,159 | 5/1969 | Sarvie | 76/101.1 |
| 4,449,390 | 5/1984 | Pontini | 72/422 |

FOREIGN PATENT DOCUMENTS

| | | | |
|---|---|---|---|
| 1049200 | 1/1959 | Fed. Rep. of Germany | 76/101.1 |

*Primary Examiner*—Roscoe V. Parker
*Attorney, Agent, or Firm*—Varndell Legal Group

[57] ABSTRACT

A hammer including a body, a handle formed integral with the body and perpendicular to the body, a hole formed in the body, and a head including a stub for engagement in the hole of the body, and the head being welded to the body such that the hammer is formed. An annular groove is formed between the head and the body for accommodating the weld metal such that the weld metal will not be protruded.

2 Claims, 3 Drawing Sheets

HAMMER AND METHOD FOR MANUFACTURE THE SAME

BACKGROUND OF THE INVENTION

1. Field of the Invention

The present invention relates to a hammer, and more particularly to a hammer and the method for manufacturing the hammer.

2. Description of the Prior Art

Typical hammer includes a head and a handle coupled together, in which, generally, the handle is made of wood materials and has one end force-fitted in an aperture formed in the head. A wedge and the like is hammered and hit into the one end of the handle so that the handle can be integrally coupled to the head. The head is apt to be disengaged from the handle after long term of use. Another type of hammer includes a handle having one end threadedly engaged to a head so that the handle can be coupled to the head. However, the head will become loose when the head is hit on an object so that the head is usually required to be rotated relative to the handle manually. This is very inconvenient.

The present invention has arisen to mitigate and/or obviate the afore-described disadvantages of the conventional hammers.

SUMMARY OF THE INVENTION

The primary objective of the present invention is to provide a hammer which has a head formed integral with a handle so that the head will not become loose relative to the handle.

Another objective of the present invention is to provide a method for manufacturing the hammer in which the hammer is made by a forging process.

In accordance with one aspect of the invention, there is provided a hammer including a body, a handle formed integral with the body and perpendicular to the body, a hole formed in the body, and a head including a stub for engagement in the hole of the body, and the head being welded to the body such that the hammer is formed. An annular groove is formed between the head and the body for accommodating the weld metal such that the weld metal will not be protruded.

In accordance with another aspect of the invention, there is provided a method for manufacturing a hammer, the method includes the following processes: preparing a lower mold fixed on a base of a forging machine and an upper mold coupled to a piston rod of a cylinder and movable downward toward the lower mold in order to conduct forging operations, the lower mold including an even number of mold cavities formed therein, the upper mold also including an even number of mold cavities formed therein corresponding to the mold cavities of the lower mold, the mold cavities of the lower mold and of the upper mold being arranged anti-symmetrically such that the centers of gravity and the mass centers of the lower mold and the upper mold are identical and are located at the geometrical centers thereof; disposing a material in each of the mold cavities of the lower mold, the material being heated to a temperature preferably higher than 900° C.; moving the upper mold downward toward the lower mold in a reciprocating action in order to conduct forging operations so that a blank including an even number of prototypes of hammers is formed, the prototypes of hammers being connected by excess materials; punching the blank in order to remove the excess materials so that the prototypes of hammers are separated; finishing the prototypes of hammers in order to form the hammers such that an even number of hammers can be formed simultaneously.

Further objectives and advantages of the present invention will become apparent from a careful reading of the detailed description provided hereinbelow, with appropriate reference to the accompanying drawings.

DETAILED DESCRIPTION OF THE INVENTION

Figures 1, 2:
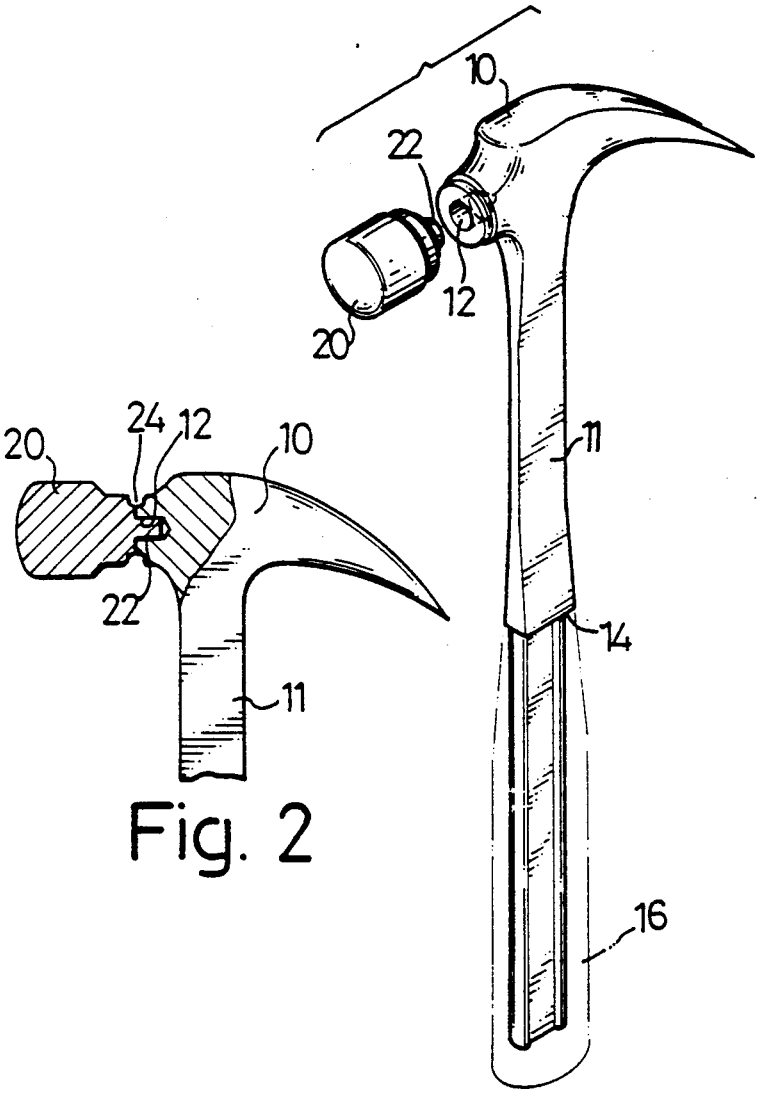
FIG. 1 is a partial exploded view of a hammer in accordance with the present invention.
FIG. 2 is a plane schematic view illustrating the coupling of the head to the body of the hammer.

Referring to the drawings and initially to FIGS. 1 and 2, a hammer in accordance with the present invention comprises generally a body 10 having a hole 12 formed therein; a handle 11 substantially perpendicular to the body 10 and formed integral with the body 10; and a head 20 having a stub 22 extended therefrom for engagement with the hole 12 of the body 10 such that the head 20 can be engaged to the body 10. The head 20 and the body 10 are welded together, for example.

As shown in FIG. 2, an annular groove 24 is formed between the body 10 and the head 20 when the stub 22 of the head 20 is engaged into the hole 12 of the body 10. The weld metal for coupling the head 20 and the body 10 together can be received in the annular groove 24 so that the weld metal will not be protruded. A shoulder 14 is preferably formed in the middle portion of the handle 11. A hand grip 16 is disposed on the free end portion of the handle 11. It is to be noted that the body 10 is formed integral with the handle 11, and the head 20 is integrally fixed to the body 10 so that the hammer has an excellent strength.

It is further to be noted that the head 20 is the only place in the hammer to be hit and struck onto the nail and the like, which means that the head 20 is the only portion of the hammer which needs excellent hardness and solidity. Accordingly, the head 20 is the only portion of the hammer required to be heat treated. In the hammer according to the present invention, the head 20 is formed and manufactured separately such that the other portion of the hammer is not required to be heat treated and such that the manufacturing cost of the hammer is greatly reduced.

It is to be noted that the head 20 and the body 10 can be directly formed together by the forging processes, which will be described below, without welding processes if the head portion of the hammer is not required to have high hardness and solidity.

Figure 3:
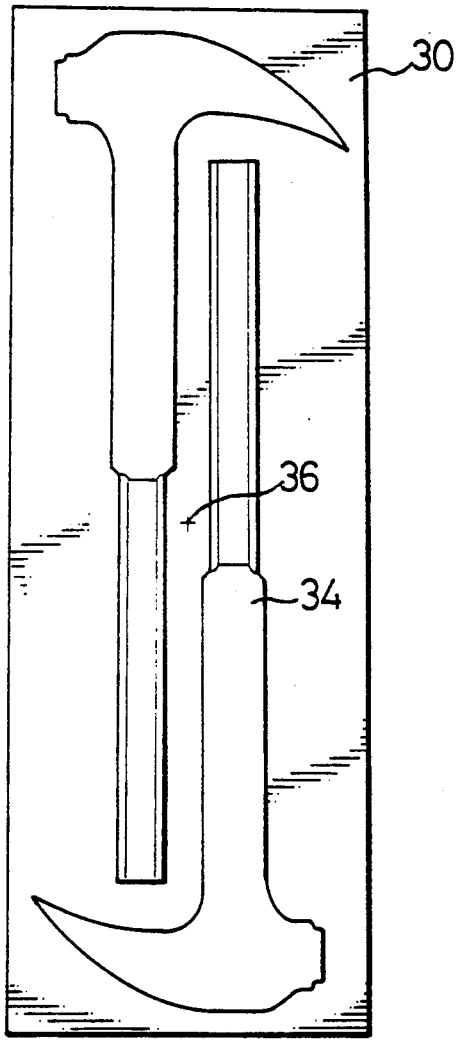
FIG. 3 is a top view of the mold for manufacturing the hammers.
Figure 4:
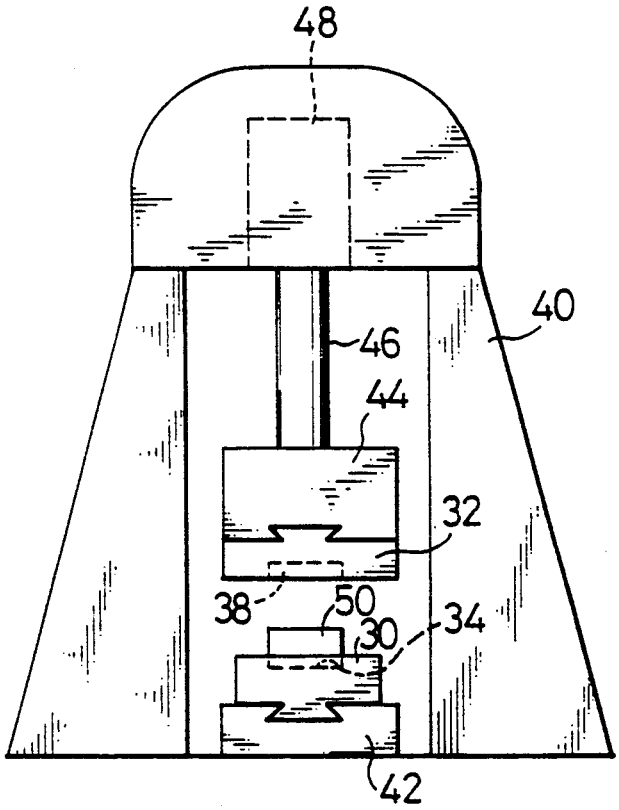
FIG. 4 is a schematic view illustrating the forging machine for forming the hammers.

Referring next to FIGS. 3 and 4, illustrated is a forging method for manufacturing the hammer. A forging press is shown in FIG. 4 and includes a lower mold 30 fixed to a base or a working table 42 thereof, and an upper mold 32 fixed to a block 44 which is fixed to the lower end of a piston rod 46 of a cylinder 48, such as pneumatic cylinder or hydraulic cylinder, so that the upper mold 32 is movable downward toward the lower mold 30 in order to conduct forging processes.

As shown in FIG. 3, two mold cavities 34 are formed in the lower mold 30 and are arranged anti-symmetrically such that the center of gravity and the mass center of the lower mold 30 are identical and are located at the geometrical center 36 of the lower mold 30. Similarly, the upper mold 32 also includes two mold cavities 38 formed therein corresponding to the mold cavities 34 of the lower mold 30 and arranged such that the center of gravity and the mass center and the geometrical center thereof are identical and are located in the longitudinal axis of the piston rod 46. This is very important because the force and stress distribution is symmetrical and uniform during forging operations, such that the molds will not be easily damaged and such that the working life of the molds can be increased.

As shown in FIG. 4, a material 50 which has been heated to a temperature higher than 1100° C. is disposed in each of the mold cavities 34 of the lower mold 30. The upper mold 32 moves downward repeatedly toward the lower mold 30 in a reciprocating action in order to conduct forging operations, such that a blank including two prototypes of hammers is formed. The prototypes of the hammers are still connected together by excess materials which are punched off from the blank by a punching process. The prototypes of hammers are then subjected to finishing processes including grinding and polishing processes. Two hammers are thus formed simultaneously if the head portions are directly formed on the hammers respectively. Since the hammers are made by forging processes, the outer surfaces of the hammers are smooth.

However, if the heads 20 are manufactured separately, a hole 12 is drilled in each of the bodies for receiving the stub 22 of the head 20, and the head 20 is welded to the body 10 so that a hammer is formed.

Alternatively, four, six or any other even number of mold cavities can be formed in each of the molds, such that four, six or an even number of hammers can be formed simultaneously.

Accordingly, the hammer in accordance with the present invention has an excellent strength and an excellent outer appearance, and the manufacturing cost thereof can be greatly decreased. In addition, the body and the head will not become loose relative to the handle.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for manufacturing a hammer comprising:

preparing a lower mold fixed on a base of a forging machine and an upper mold movable downward toward said lower mold in order to conduct forging operations, said lower mold including an even number of mold cavities formed therein, said upper mold also including an even number of mold cavities formed therein corresponding to said mold cavities of said lower mold, said mold cavities being arranged anti-symmetrically such that the centers of gravity and the mass centers of said lower mold and said upper mold are identical and are located at the geometrical centers thereof;

disposing a material in each of said mold cavities of said lower mold, said material being heated to a temperature preferably higher than 900° C.;

moving said upper mold downward toward said lower mold in a reciprocating action in order to conduct forging operations so that a blank including an even number of prototypes of hammers is formed, said prototypes of hammers being connected by excess materials;

punching said blank in order to remove said excess materials so that said prototypes of hammers are separated;

finishing said prototypes of hammers in order to form said hammers such that an even number of hammers can be formed simultaneously.

2. A method for manufacturing a hammer comprising:

preparing a lower mold fixed on a base of a forging machine and an upper mold movable downward toward said lower mold in order to conduct forging operations, said lower mold including an even number of mold cavities formed therein, said upper mold also including an even number of mold cavities formed therein corresponding to said mold cavities of said lower mold, said mold cavities being arranged anti-symmetrically such that the centers of gravity and the mass centers of said lower mold and said upper mold are identical and are located at the geometrical centers thereof;

disposing a material in each of said mold cavities of said lower mold, said material being heated to a temperature preferably higher than 900° C.;

moving said upper mold downward toward said lower mold in a reciprocating action in order to conduct forging operations so that a blank including an even number of prototypes is formed, said prototypes being connected by excess materials;

punching said blank in order to remove said excess materials so that said prototypes are separated;

finishing said prototypes, each of said prototypes including a body and a handle of said hammer;

drilling a hole in said body of each of said prototypes;

preparing a head which includes a stub formed integral therewith and engageable in said hole of said prototype;

welding said head to said body of each of said prototypes;

whereby, said hammer is formed.

* * * * *